US008881709B2

(12) United States Patent
Kim et al.

(10) Patent No.: US 8,881,709 B2
(45) Date of Patent: Nov. 11, 2014

(54) FLUID INJECTOR WITH BACK END RATE SHAPING CAPABILITY

(75) Inventors: Hoisan Kim, Dunlap, IL (US); Mark F. Sommars, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 564 days.

(21) Appl. No.: 13/168,420

(22) Filed: Jun. 24, 2011

(65) Prior Publication Data

US 2011/0253105 A1 Oct. 20, 2011

Related U.S. Application Data

(63) Continuation-in-part of application No. 12/552,523, filed on Sep. 2, 2009, now abandoned.

(51) Int. Cl.
*F02M 57/02* (2006.01)
*F02M 63/00* (2006.01)
*F02M 47/02* (2006.01)

(52) U.S. Cl.
CPC ..... *F02M 47/027* (2013.01); *F02M 63/0063* (2013.01); *F02M 63/0015* (2013.01)
USPC ..... 123/446; 123/445; 123/496; 239/88; 239/585.1

(58) Field of Classification Search
USPC ..... 123/445, 446, 447, 496; 239/533.2, 239/533.8, 533.9
See application file for complete search history.

(56) References Cited

U.S. PATENT DOCUMENTS 4,674,688 A * 6/1987 Kanesaka ..... 239/533.8
4,719,889 A 1/1988 Amann et al.
4,776,518 A * 10/1988 Yamamoto ..... 239/533.4
5,219,122 A * 6/1993 Iwanaga ..... 239/533.8
5,467,754 A * 11/1995 Beck et al. ..... 123/467
5,472,142 A * 12/1995 Iwanaga ..... 239/96
5,575,425 A * 11/1996 Yoshizu ..... 239/533.8
5,826,793 A * 10/1998 Askew ..... 239/124
5,894,992 A 4/1999 Liu et al.
6,119,959 A * 9/2000 Smith et al. ..... 239/89
6,371,084 B1 4/2002 Betz
6,626,371 B1 9/2003 Boecking
6,745,952 B1 6/2004 Hlousek
6,793,161 B1 9/2004 Fujita et al.
6,820,827 B1 11/2004 Boecking
6,935,580 B2 * 8/2005 Azam et al. ..... 239/533.5
7,097,115 B2 * 8/2006 Jiang et al. ..... 239/88
7,124,744 B2 10/2006 Weimken et al.
7,591,436 B2 * 9/2009 Ganser ..... 239/96
2002/0125339 A1 * 9/2002 Perr et al. ..... 239/96
2005/0023372 A1 * 2/2005 Weimken et al. ..... 239/88
2005/0072856 A1 * 4/2005 Ganser et al. ..... 239/96
2005/0194462 A1 * 9/2005 Coldren et al. ..... 239/88
2008/0006712 A1 * 1/2008 Benson et al. ..... 239/5
2008/0053410 A1 * 3/2008 Gant ..... 123/472
2008/0223959 A1 9/2008 Kurz
2009/0321542 A1 12/2009 Ricco et al.

* cited by examiner

*Primary Examiner* — Erick Solis
*Assistant Examiner* — Anthony L Bacon
(74) *Attorney, Agent, or Firm* — Carl E. Myers

(57) ABSTRACT

A common rail single fluid injection system includes fuel injectors ramp shaped injection curves at both the front and back ends of an injection event. This is accomplished by including a check speed control device fixed in position within the check control chamber of a fuel injector. The check speed control device controls the speed of a check by restricting fuel flowing into and out of the check control chamber.

20 Claims, 5 Drawing Sheets

FLUID INJECTOR WITH BACK END RATE SHAPING CAPABILITY

CROSS-REFERENCE TO RELATED APPLICATIONS

This is a continuation-in-part to U.S. patent application Ser. No. 12/552,523, filed on Sep. 2, 2009 now abandoned.

TECHNICAL FIELD

The present disclosure relates generally to a single fluid fuel injection system, and more particularly to fuel injection systems with rate shaping capabilities.

BACKGROUND

Engines, including diesel engines, gasoline engines, natural gas engines, and other engines known in the art, exhaust a complex mixture of combustion related constituents. The constituents may be gaseous and solid material, which include nitrous oxides (NOx) and particulate matter. Due to increased attention on the environment, exhaust emission standards have become more stringent and the amount of NOx and particulate matter emitted from an engine may be regulated depending on the type of engine, size of engine, and/or class of engine.

Engineers have come to recognize that undesirable engine emissions, such as NOx, particulate matter, and unburnt hydrocarbons, can be reduced across an engine's operating range with fuel injection systems with maximum flexibility in controlling injection timing, flow rate, injection quantity, injection rate shapes, end of injection characteristics and other factors known in the art. The desire for maximum flexibility is often tempered by the need to manage costs associated with fuel injection system components and manufacturability, the need for a robust system, the desire to reduce performance variations among fuel injectors in a system, and other factors known in the art. These issues were initially addressed by introducing an electrical actuator into fuel injectors in order to gain some threshold controllability over injection timing and quantity independent of engine crank angle. In the case of common rail fuel injection systems, this threshold control is often accomplished either by including an electronically controllable admission valve or an electronically controllable direct control needle valve. In the former case, the fuel injector's nozzle chamber is opened and closed to a fluid connection with the high pressure fuel rail by opening and closing an admission valve via an electrical actuator. In some instances, the admission valve is directly coupled to an electrical actuator, such as a solenoid, and in other instances the admission valve is pilot operated. In other common rail fuel injection systems, the nozzle chamber remains fluidly connected to the high pressure rail at all times, but the nozzles are opened and closed by relieving pressure on a closing hydraulic surface of a direct control needle valve. Although these common rail fuel injection systems have many desirable aspects, the ability to maximize flexibility in injection characteristics has remained elusive.

In one example common rail fuel injector disclosed in U.S. Pat. No. 5,984,200 to Augustin, a pilot operated admission valve supposedly includes features that allow the fuel injector to provide a relatively slow rate of injection toward the beginning of an injection event to produce what is commonly referred to in the art as a ramp shaped injection event. While it is true that ramp shaped injection events have proven effective in reducing undesirable emissions at some engine operating conditions, other engine operating conditions often demand different injection characteristics to effectively reduce undesirable emissions. Among these other desired injection characteristics are split injections, the ability to produce square front end injection rate shapes, and the ability to abruptly end injection events. Thus, it has proven problematic to produce common rail fuel injectors with an expanded range of capabilities.

The disclosed fuel injector with rate shaping capability is directed to overcoming one or more of the problems set forth above.

SUMMARY OF THE DISCLOSURE

In one aspect, a fuel injector includes an injector body defining a high pressure inlet, a nozzle supply passage, a check control chamber, a check control line, a low pressure drain and at least one nozzle outlet. The fuel injector also includes a check speed control device fixedly positioned within the check control chamber and having an upper bowl, a lower bowl and at least one orifice through the lower bowl. Also included is a control valve assembly having a valve member configured to selectively allow fluid communication from the upper bowl and check control line to the low pressure drain. The fuel injector also includes a check needle movable within the injector body between a first position at which the check needle blocks the at least one nozzle outlet and a second position at which the check needle at least partially opens the at least one nozzle outlet. The check needle further including at least one opening hydraulic surface exposed to a fluid pressure of the nozzle supply passage and at least one closing hydraulic surface exposed to a fluid pressure of the first check control chamber.

In another aspect, a method of controlling a closing speed of a check needle during an injection event, said method includes a step of moving a check needle from a first position to a second position by expelling fluid from a check control chamber to a low pressure drain, wherein at said first position, the check needle blocks an at least one nozzle outlet, and at said second position the check needle at least partially unblocks the at least one nozzle outlet. Also included is a step of moving the check needle from the second position to the first position by preventing fluid communication between the check control chamber and the low pressure drain and filling the check control chamber with fluid. Also included is a step of limiting a speed of the check needle as it moves from the second position to the first position by restricting the fluid filling the check control chamber with a check speed control device fixedly positioned within the check control chamber and having an upper bowl, a lower bowl and at least one orifice through the lower bowl.

In another aspect, an internal combustion engine includes an engine housing defining a plurality of engine cylinders, and a plurality of pistons each being movable within a corresponding one of the engine cylinders. A fuel system including a plurality of fuel injectors associated one with each of the plurality of engine cylinders, each of the fuel injectors including a cavity having an upper surface and a lower surface, and having a check speed control device having an upper and lower surface and an orifice positioned therein. The space between the upper surface of the check speed control device and the upper surface of the cavity defines a first check control chamber, and the space between the lower surface of the check speed control device and the lower surface of the cavity defines a second check control chamber. The first and second check control chambers are fluidly connected to one another via the orifice. Each of the plurality of fuel injectors further includes a check movable a check travel distance to control an injection of fuel into the associated engine cylinder and at least one closing hydraulic surface exposed to a fluid pressure of the second check control chamber.

DETAILED DESCRIPTION

Figure 1:
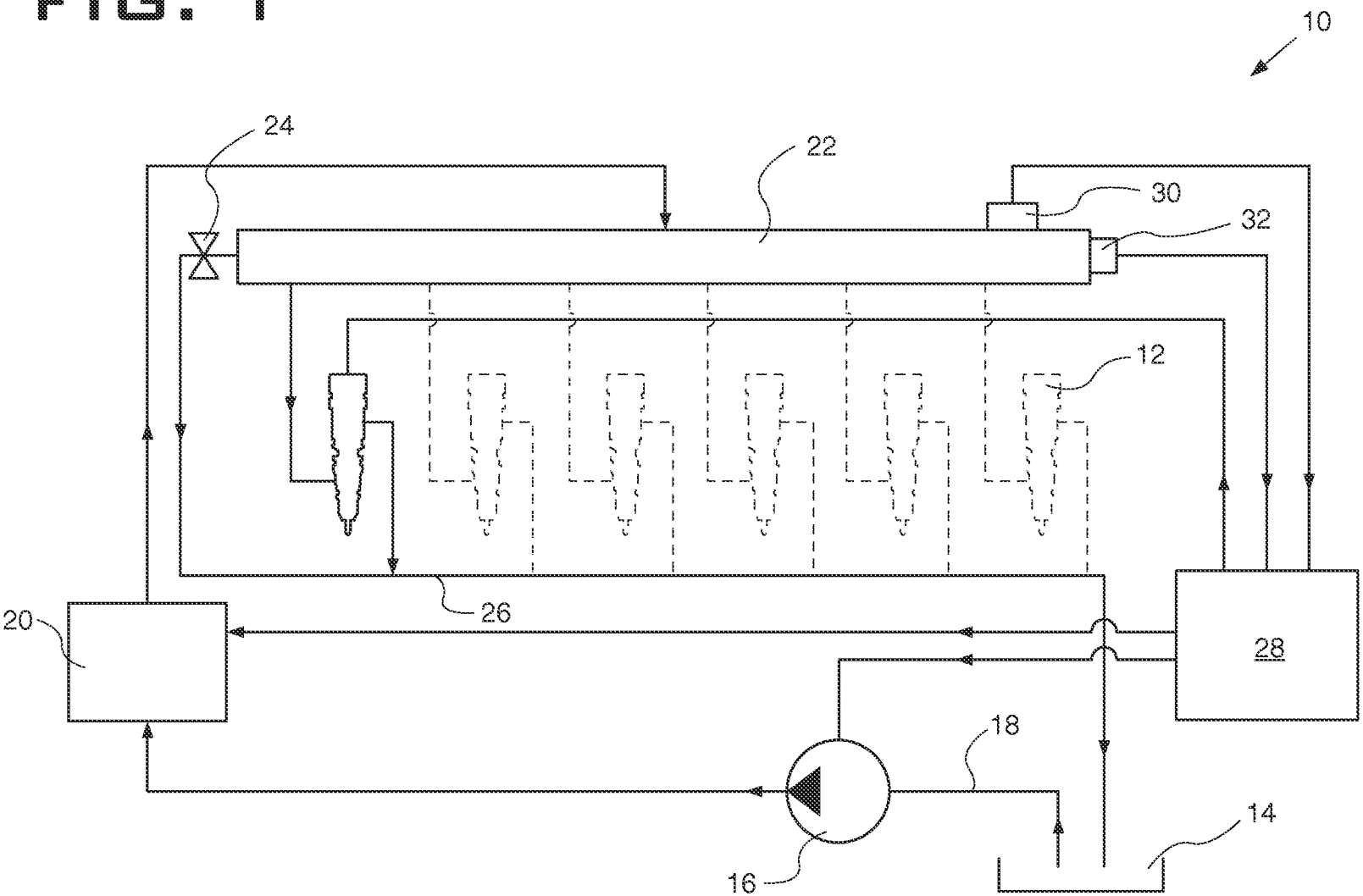
FIG. 1 is a diagrammatic schematic of a fuel system using a common rail fuel injector.

Referring to FIG. 1, a common rail fuel system 10 including at least one fuel injector 12. A fuel source 14 may contain fuel at an ambient pressure. Said fuel may be a diesel distillate fuel. A transfer pump 16 may draw fuel from fuel source through fuel supply line 18 and deliver it to a high pressure fuel pump 20. High pressure fuel pump 20 may then pressurize the fuel to the desired pressure and deliver it to fuel rail 22. The pressure of the fuel in fuel rail 22 may be regulated in part by a safety valve 24. Safety valve 24 may spill fuel from the fuel rail 22 to the fuel return line 26 if the fuel in the fuel rail 22 is higher than a desired pressure. Fuel return line 26 returns fuel to the fuel source 14. Fuel rail 22 is also configured to deliver fuel to fuel injectors 12. Fuel injectors 12 are configured to inject fuel into a combustion chamber of an engine (not shown). Fuel not injected by fuel injectors 12 is spilled to fuel return line 26, and ultimately returned to fuel source 14.

An electronic control module (ECM) 28 may provide general control for the fuel system 10. ECM 28 may receive various input signals, such as from a pressure sensor 30 and a temperature sensor 32 connected to fuel rail 22, to determine operational conditions. ECM 28 may then send out various control signals to various components including the transfer pump 16, high-pressure fuel pump 20, and fuel injector 12.

Figure 2:
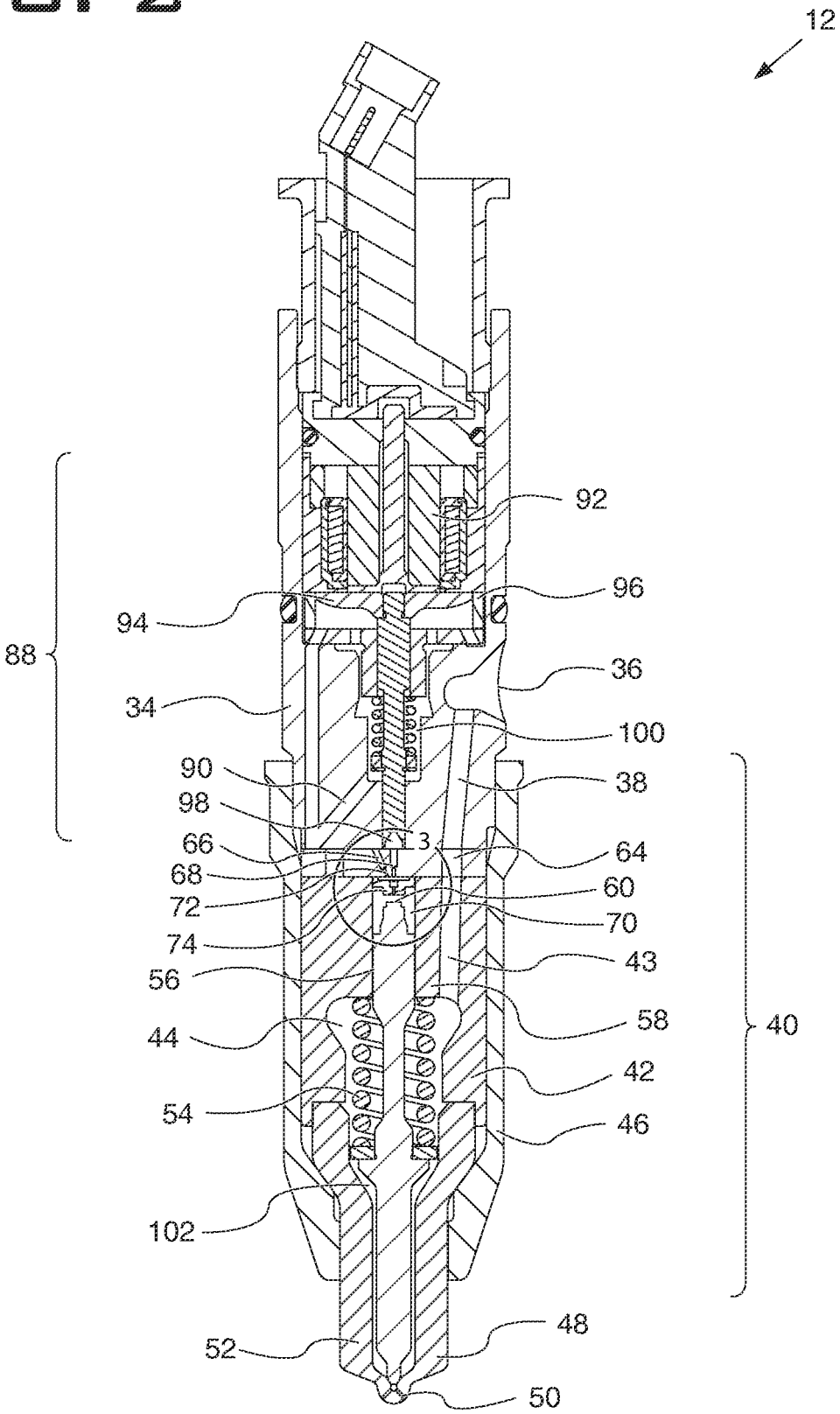
FIG. 2 is a cross section of a common rail fuel injector utilizing a check speed control device.

Referring now to FIG. 2, the internal structure and fluid circuitry of each fuel injector 12 is illustrated. Fuel injector 12 includes an injector body 34. Injector body 34 may define a high pressure fuel inlet 36 and a high pressure supply passage 38. High pressure supply passage 38 supplies high pressure fuel to a nozzle assembly 40.

Nozzle assembly 40 may include a nozzle body 42, which defines a nozzle cavity 44. Nozzle body 42 may further define a fuel supply passage 43. Nozzle cavity 44 is in fluid communication with the high pressure supply passage 38 via fuel supply passage 43. Nozzle assembly 40 may further include a check needle 46. Check needle 46 may be disposed within nozzle cavity 44. Nozzle assembly 40 may further include a nozzle tip 48, which includes at least one injection orifice 50. As will be described in greater detail, check needle 46 is movable between a first position and a second position. In the first position, a first end 52 of check needle 46 is in contact with nozzle tip 48 such that it at least partially blocks fluid communication between the nozzle cavity 44 and the at least one injection orifice 50. In the second position, the first end 52 of check needle 46 is out of contact with nozzle tip 48 such that fluid communication between the nozzle cavity 44 and the at least one injection orifice 50 is allowed. A biasing spring 54 may also be disposed within nozzle cavity 44. Biasing spring 54 may be configured to bias check needle 46 toward its first position. Nozzle body 42 may further define a check guide bore 56 in which a second end 58 of check needle 46 is disposed. The second end 58 of check needle 46 includes at least one closing hydraulic surface 60.

Nozzle assembly 40 may further include an orifice plate 62. Orifice plate 62 defines a fuel supply orifice 64. Fuel supply orifice 64 facilitates fluid communication between high pressure supply passage 38 and fuel supply passage 43. Orifice plate 62 further defines a z-orifice 66 and an a-orifice 68. Orifice plate 62 may be disposed atop nozzle body 42. A check control chamber 70 may be defined by a lower surface 72 of the orifice plate 62 and a space within the check guide bore 56 and above the second end 58 of check needle 46. The closing hydraulic surface 60 of check needle 46 is exposed to the check control chamber 70. Check control chamber 70 further includes a check speed control device 74 fixedly positioned therein.

Figure 4:
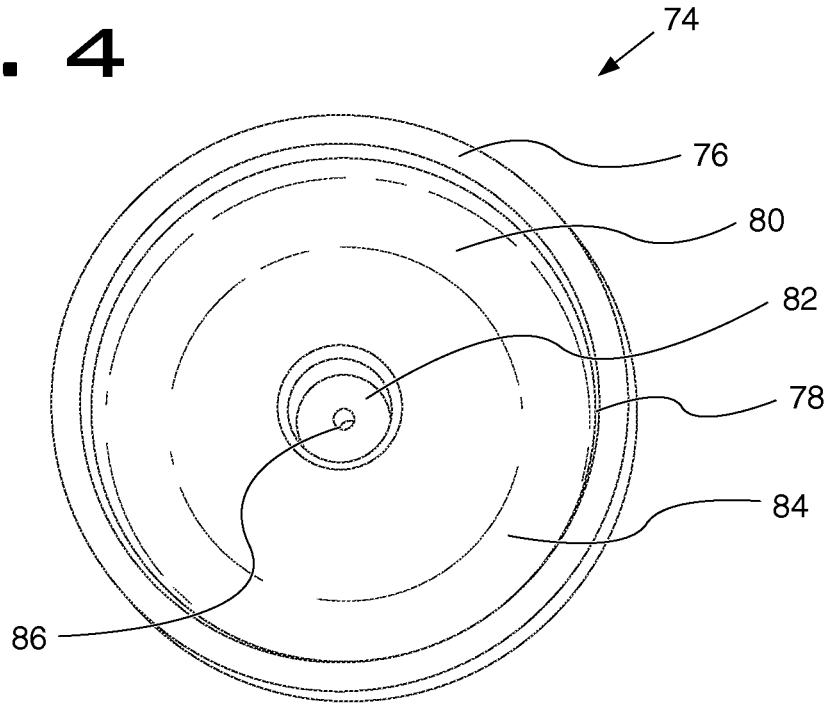
FIG. 4 is a plan view of an exemplary check speed control device.
Figure 5:
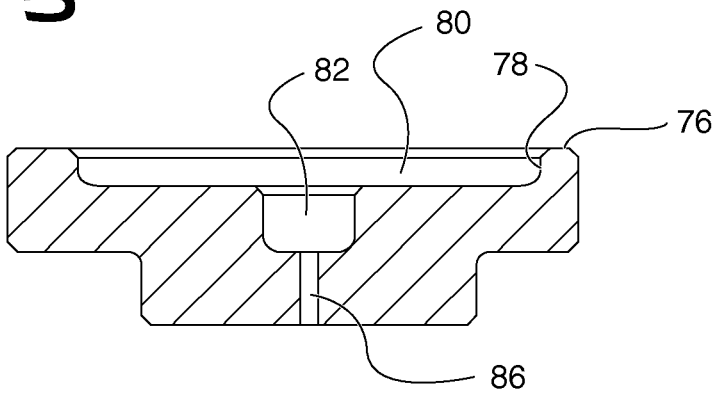
FIG. 5 is a cross section view of an exemplary check speed control device.

As shown in FIGS. 4 and 5, check speed control device 74 may be a substantially circular device that includes a rim 76. Rim 76 may be surface that is welded to the lower surface 72 of orifice plate 62. In this way, check speed control device 74 may be fixedly positioned within the check control chamber 70. Those skilled in the art will recognize that there are other ways to fixedly position the check speed control device 74 within the check control chamber 70.

Rim 76 may be a part of a raised wall 78. Raised wall 78 follows the circumference of check speed control device 74. Raised wall 78 forms an outer boundary of an upper bowl 80. Check speed control device 74 may further define a lower bowl 82. Lower bowl 82 may have a smaller radius than upper bowl 80 and may be positioned such that it is on a different vertical plane than the upper bowl 80. Alternate embodiments such as that shown in FIG. 4 may include at least one middle bowl 84. Middle bowl may have a radius smaller than that of the upper bowl 80 but larger than that of the lower bowl. Middle bowl 84 may also be positioned in between and on a different vertical plane than the upper bowl 80 and the lower bowl 82. In every embodiment, the lower bowl 82 of the check speed control device 74 includes at least one orifice 86. Orifice 86 facilitates fluid communication between the check control chamber 70, the lower bowl 82 and the upper bowl 80. Those skilled in the art will recognize that in embodiments that include at least one middle bowl 84, the orifice 86 will facilitate fluid communication between the check control chamber 70, the lower bowl 82, the middle bowl 84 and the upper bowl 80.

Figure 3:
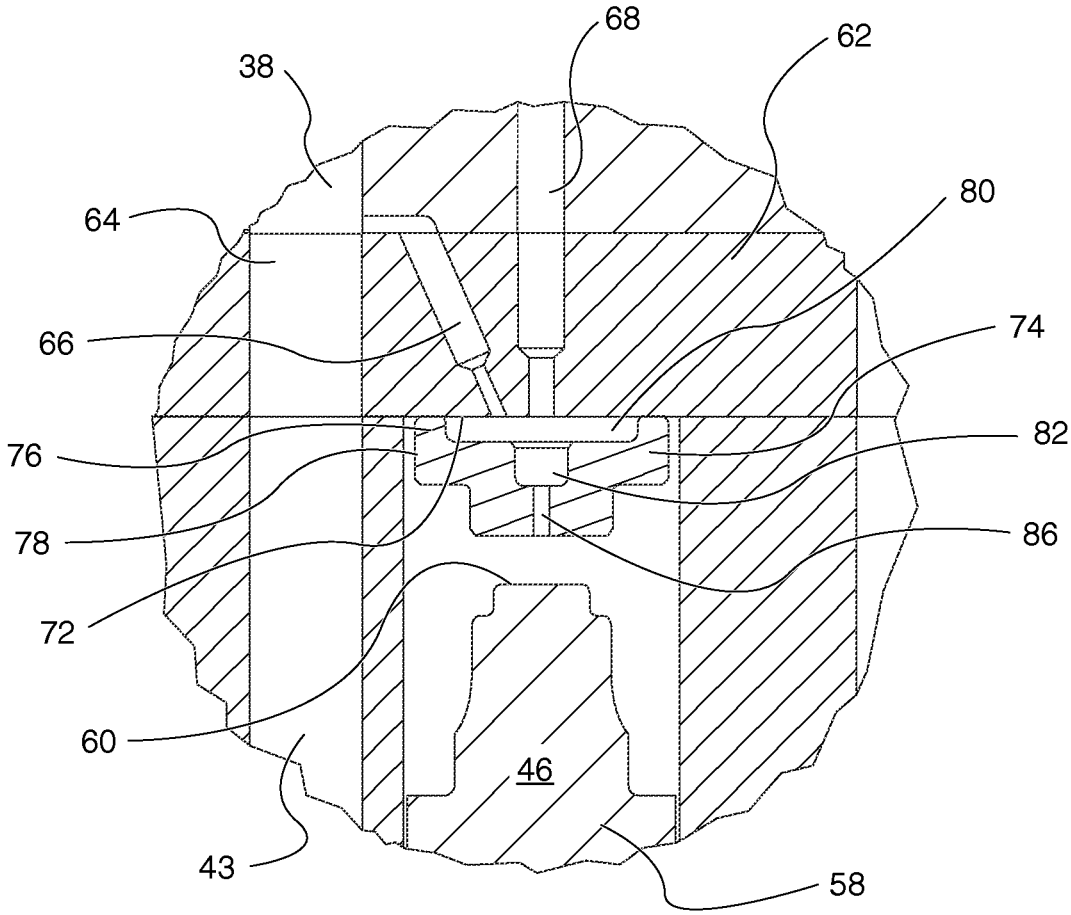
FIG. 3 is an inset of the injector of FIG. 2 showing the detail of one embodiment of the check speed control device.
Figure 6:
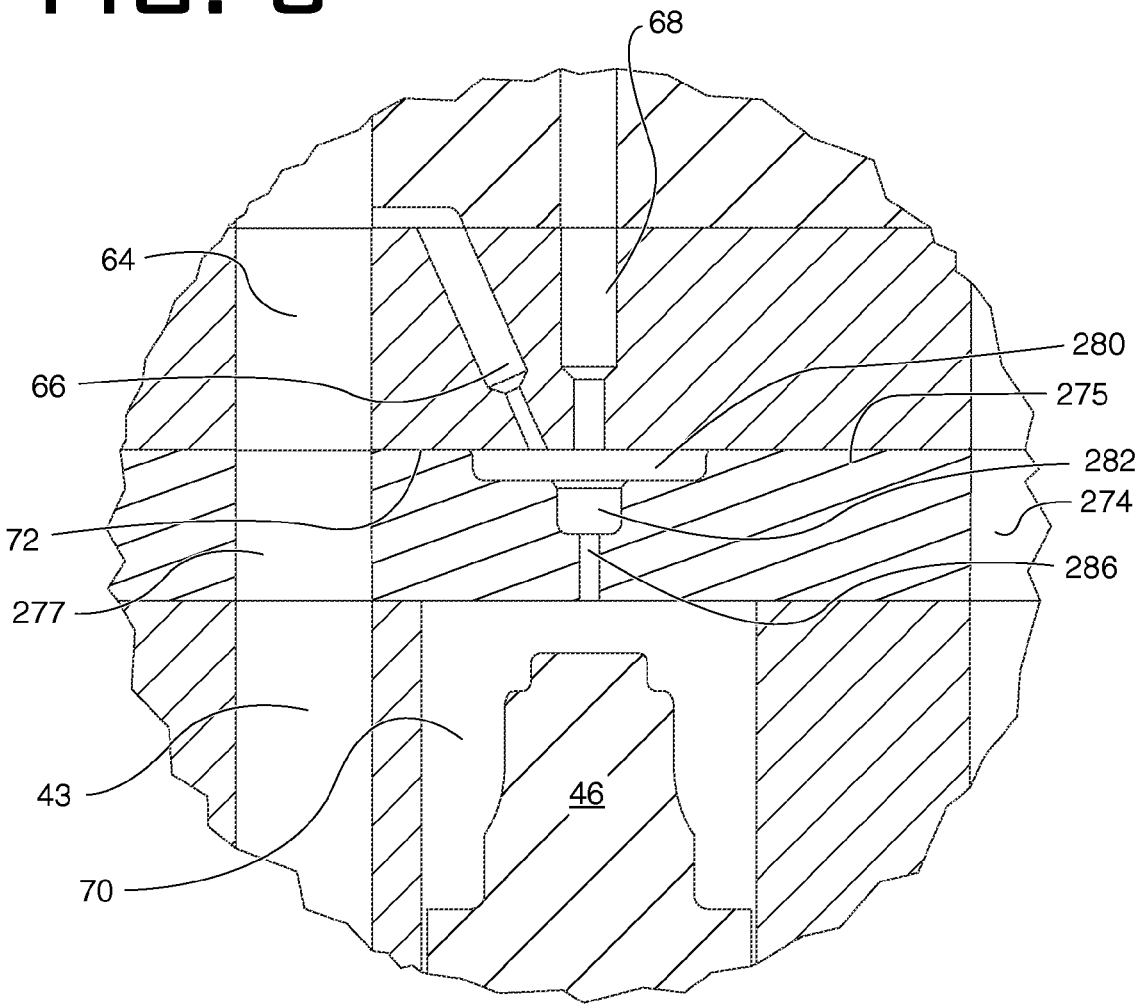
FIG. 6 is a view of an alternate embodiment of the check speed control device.

FIG. 6 depicts an alternate embodiment of a check speed control device 274. For ease of comparison, similar components will be referred to with similar reference numerals in the "200" series. As discussed infra, check speed control device 274 is positioned and operates in a manner nearly identical to that of check speed control device 74 (See FIG. 3). Check speed control device 274 differs from check speed control device 74 in that instead of machining the exterior surfaces like those of check speed control device 74, only the operative interior surfaces of check speed control device 274 are machined. In particular, the upper bowl 280, lower bowl 282, and orifice 286 are machined out of a single plate 275. Those skilled in the art will recognize that the embodiment of the check speed control device 274 of FIG. 6 could further include a machined middle bowl (not shown). The check speed control device is in a fixed position. Plate 275 may be welded to the lower surface 72 of orifice plate 62. Those skilled in the art will readily recognize other methods of fixing the check speed control device 274 in place. The machined upper bowl 280, lower bowl 282, and orifice 286 of check speed control device 274 are positioned such that they are in fluid communication with z-orifice 66, a-orifice 68, and check control chamber 70. Plate 275 further includes at least one passageway 277 that is in fluid communication with both fuel supply orifice 64 and fuel supply passage 43. Specifically, passageway 277 facilitates fluid communication of high-pressure fuel from the fuel inlet 36 to the nozzle cavity 44. As will be discussed below, check speed control device 274 operates in a manner identical to that of check speed control device 74.

Returning now to FIG. 2, fuel injector 12 may further include a control valve assembly 88. Control valve assembly 88 may at least partially be disposed within injector body 34 and configured to selectively allow fluid communication between the check control chamber 70 via the a-orifice 68 and a low pressure drain 90 formed in the injector body 34. Control valve assembly 88 may include an electrical actuator 92 such as a solenoid or piezo actuated group. Control valve assembly 88 may further include an armature 94 coupled to piston 96. Control valve assembly 88 may further include a valve member 98. Valve member 98 may be a ball valve having a flat. Valve member 98 may further be positioned atop orifice plate 62 such that it selectively blocks and unblocks fluid communication between the a-orifice 68 and the low-pressure drain 90. Control valve assembly 88 may also include a biasing spring 100. Biasing spring 100 may be configured to bias piston 96 downward so that valve member 98 is normally preventing fluid communication between the a-orifice 68 and the low-pressure drain 90.

The operation of fuel injector 12 will now be explained. The opening and closing of check needle 46 is controlled by control valve assembly 88, which regulates the flow of pressurized fuel out of check control chamber 70. When the electrical actuator 92 of the control valve assembly 88 is not energized, biasing spring 100 biases piston 96 downward such that valve member 98 blocks the a-orifice 68. When valve member 98 is in this position, high-pressure fluid from fuel inlet 36 travels into high-pressure supply passage 38 and fuel supply orifice 64. A majority of the fuel is delivered to the nozzle cavity 44 via fuel supply passage 43. However, a portion of the fuel in fuel supply orifice 64 is directed to z-orifice 66, wherein the fuel is directed to the check control chamber 70. More specifically, the fuel from the z-orifice 66 is supplied to the upper bowl 80 of the check speed control device 74. As the upper bowl 80 is filled, fuel spills into the lower bowl 82 and then ultimately out orifice 86 and into the check control chamber 70 where it fills the same. Thus, high-pressure fuel fills both check control chamber 70 and the nozzle cavity 44. When this occurs, there is a force balance above and below the check needle 46. Biasing spring 54 keeps check needle 46 in its first position, wherein the first end 52 blocks injection orifice 50 and injection is prevented.

When injection is desired, electrical actuator 92 is energized thereby creating an electromagnetic field that attracts armature 94. Armature 94 and coupled piston 96 overcome the downward bias of biasing spring 100 and are drawn toward electrical actuator 92. When this occurs, valve member 98 unblocks the a-orifice 68 and allows fuel from the check control chamber 70 to flow through the a-orifice 68 to low-pressure drain 90. More specifically, fuel within the upper bowl 80 and lower bowl 82 flow out a-orifice 68 to the low pressure drain 90. The remaining fuel in the check control chamber 70 then flows though through orifice 86 into the lower bowl 82, upper bowl 80 and out the a-orifice 68 to the low-pressure drain 90.

As pressurized fluid flows out of the check control chamber 70, the pressure within the same drops. When this occurs, the force balance that was achieved by having pressurized fuel both above and below the check needle 46 is lost. Pressurized fuel in the nozzle cavity 44 then acts on at least one opening hydraulic surface 102 of check needle 46 causing check needle 46 to overcome the downward bias of biasing spring 54 and lift. Fuel within nozzle cavity 44 is then injected via injection orifice 50.

When it is desired to end injection, electrical actuator 92 is deenergized. When this occurs, the electromagnetic field created by an energized electrical actuator 92 is dissipated. In the absence of an electromagnetic field, armature 94 and coupled piston 96 are no longer drawn towards electrical actuator 92. Biasing spring 100 then biases piston downward toward its initial position. Piston 96 causes valve member 98 to its initial position, wherein it blocks the a-orifice and prevents fluid communication between the check control chamber 70 and the low-pressure drain 90. More specifically, fluid communication between the upper bowl 80, lower bowl 82 and the low-pressure drain is prevented.

At this point, a portion of the fuel from the fuel inlet 36 is allowed to enter the z-orifice 66, wherein pressurized fuel begins to refill the check control chamber 70. More specifically, pressurized fuel travels through the z-orifice 66 into the upper bowl 80 and lower bowl 82 of the check speed control device 74. Pressurized fuel then travels through orifice 86 and into the check control chamber 70 wherein it acts on a closing hydraulic surface 60 of check needle 46. Fuel from the fuel inlet 36 is also simultaneously delivered to the nozzle cavity 44 via high-pressure supply passage 38, fuel supply orifice 64, and fuel supply passage 43. With pressurized fuel both above and below the check needle 46, a force balance is achieved. The downward force of biasing spring 54 is now enough to cause check needle 46 to move to its first position, wherein the first end 52 blocks injection orifice 50. Thus, the injection event is ended.

The speed at which the check needle 46 opens and closes is influenced by the presence of the check speed control device 74. In standard common rail fuel injectors without a check speed control device, the check needle opens quickly and fully at the beginning of injection events. Likewise, at the end of injection events or on the back end, the check needle closes quickly and fully. These quick motions occur because the only restriction on fluid leaving the check control chamber is caused by the a-orifice.

When it comes to controlling the speed of the opening check needle 46, or front end of injection, the check speed control device 74, 274 of the present application is similar to that of parent application U.S. patent application Ser. No. 12/552,523. In that application, a check speed control device was positioned within the check control chamber such that it was movable axially. On the front end of injection events, the opening check needle is slowed because hydraulic forces within the check control chamber press the check speed control device to the top of the check control chamber and fuel leaving the check control chamber is restricted by the orifice between the check control chamber and the lower bowl. In this manner, the check speed control device functioned as if it were fixed in position in the check control chamber like the check speed control device of the present disclosure.

On the back end of injection events, the fixed nature of the check speed control device 74, 274 of the present application functions very differently. Specifically, the closing of the check needle 46 is slowed significantly because the filling of check control chamber 70 is inhibited because of the presence and fixed position of the check speed control device 74, 274. Because of the fixed position of the check speed control device 74, 274 within the check control chamber 70, the refilling of the check control chamber with pressurized fuel is restricted. Pressurized fuel from the z-orifice 66 is delivered to the upper bowl 80 of the check speed control device 74, 274. That fuel flows into the lower bowl 82, 282 and ultimately out orifice 86, 286 and into the check control chamber 70 at large where it can act on the act on the closing hydraulic surface 60 of the second end 58 of the check needle 46. The restricted flow of pressurized fuel into the check control chamber 70 necessarily means that it takes longer for the check control chamber to fill with fuel. Thus, it takes longer for a sufficient amount of pressure to build in the check control chamber 70 to create a force balance between it and the nozzle cavity 44, wherein the biasing spring 54 can cause the check needle 46 to return to its first position.

Figure 7:
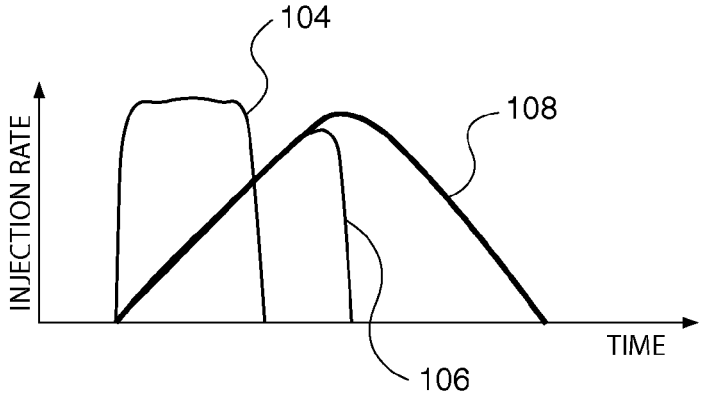
FIG. 7 is a graph depicting various injection rate delivery curves.

The affect that the check speed control device 74, 274 of the present disclosure has on fuel injection curves can be seen in FIG. 7. FIG. 7 shows several model a fuel injection curves, including a curve 104 for a fuel injector without a check speed control device; a curve 106 for a fuel injector with a movable check speed control device; and a curve 108 for a fuel injector with a fixed check speed control device. In normal common rail injectors without a check speed control device of some type, the check needle opens fully almost immediately, injects fuel for a desired time frame and then quickly closes. The injection curve represented by this type of fuel injector is commonly referred to as a square shaped injection curve 104.

Fuel injectors having a speed control device provide a differently shaped curve. This different injection curve is caused because of the restriction of fuel entering and leaving the check control chamber. For example in fuel injectors having both a movable and fixed check speed control device 74, 274 a ramp shaped front end of injection is produced. At the beginning of an injection event, the position of the check speed control device is against the lower surface of the orifice plate. The check speed control device is positioned here irrespective of whether the check speed control device is fixed as disclosed herein or is movable as disclosed in U.S. patent application Ser. No. 12/552,523. With the check speed control device 74, 274 device in such a position, fuel leaving the check control chamber 70 is restricted and the check needle does not fully open immediately. Instead, the check needle opens more slowly. Thus, a ramp shaped front of injection such as those seen in 106 and 108 are shown.

When it is desired to end injection, fuel injectors having a check speed control device produce different curves depending on whether the check speed control device is fixed or movable within the check control chamber. In fuel injectors wherein the check speed control device is movable such as that disclosed in U.S. patent application Ser. No. 12/552,523, the end of injection is more square shaped because the check speed control device is moves away from the lower surface the orifice plate thereby allowing pressurized fuel delivered through the z-orifice to enter the check control chamber with reduced restriction.

In fuel injectors such as that disclosed herein, the check speed control device 74, 274 is fixed in position within the check control chamber 70. More specifically, the check speed control device is positioned within the check control chamber such that all fuel flowing into the check control chamber must first encounter the check speed control device. Thus, at the end of an injection event, fluid flowing into the check control chamber 70 is restricted because it must first flow into the upper bowl 80, 280 of the check speed control device 74, 274. The fuel then flows into the lower bowl 82, 282 and out the orifice 86, 286. From there fuel enters the check control chamber 70 at large. Because the fuel is restricted, the closing of the check needle 46 does not occur immediately. Instead, it occurs slowly such as is shown in curve 108.

INDUSTRIAL APPLICABILITY

The present disclosure finds a preferred application in common rail fuel injection systems. In addition the present disclosure finds preferred application in single fluid, namely fuel injection, systems. Although the disclosure is illustrated in the context of a compression ignition engine, the disclosure could find application in other engine applications, including but not limited to spark ignited engines. The disclosed fuel injector has the capability of producing ramp injection shapes at both the front and back ends of an injection event. Furthermore, this injection profile can be selected independent of engine operating condition. Finally, like many electronically controlled fuel injection systems, the fuel injector 12 disclosed herein has relatively precise control over injection timing and quantity, which can be selected independent of engine speed and crank angle.

The above description is intended for illustrative purposes only and is not intended to limit the scope of the present disclosure in any way. Thus, those skilled in the art will appreciate the various modifications that can be made to the illustrated embodiments without departing from the spirit and scope of the disclosure, which is defined in the terms of the claims set forth below.

What is claimed is:

1. A fuel injector comprising:

an injector body defining a high pressure inlet, a nozzle supply passage, a check control chamber, a check control line, a low pressure drain and at least one nozzle outlet;

a check speed control device fixedly positioned within the check control chamber and having an upper bowl, a lower bowl and at least one orifice through the lower bowl;

a control valve assembly having a valve member configured to selectively allow fluid communication from the upper bowl and check control line to the low pressure drain; and a check needle movable within the injector body between a first position at which the check needle blocks the at least one nozzle outlet and a second position at which the check needle at least partially opens the at least one nozzle outlet, the check needle including at least one opening hydraulic surface exposed to a fluid pressure of the nozzle supply passage and at least one closing hydraulic surface exposed to a fluid pressure of the first check control chamber.

2. The fuel injector of claim 1, further including at least one biasing spring configured to bias the check needle toward its first position.

3. The fuel injector of claim 2, further comprising an orifice plate defining a z-orifice and an a-orifice, wherein the z-orifice facilitate fluid communication from the nozzle supply passage to the upper bowl and the a-orifice facilitates fluid communication from the upper bowl to the check control line.

4. The fuel injector of claim 3, wherein the check speed control device is welded in place within the check control chamber.

5. The fuel injector of claim 4, wherein the check speed control device is positioned above the check needle.

6. The fuel injector of claim 1, wherein the upper bowl, lower bowl and at least one orifice of the check speed control device are machined from a single plate.

7. A method of controlling a closing speed of a check needle during an injection event, said method comprising the steps of:

moving a check needle from a first position to a second position by expelling fluid from a check control chamber to a low pressure drain, wherein at said first position, the check needle blocks an at least one nozzle outlet, and at said second position the check needle at least partially unblocks the at least one nozzle outlet;

moving the check needle from the second position to the first position by preventing fluid communication between the check control chamber and the low pressure drain and filling the check control chamber with fluid;

limiting a speed of the check needle as it moves from the second position to the first position by restricting the fluid filling the check control chamber with a check speed control device fixedly positioned within the check control chamber and having an upper bowl, a lower bowl and at least one orifice through the lower bowl.

8. The method of claim 7 wherein the check needle includes a first check needle end which blocks the nozzle outlet at the first position and a second check needle end whereupon the at least one closing hydraulic surface is disposed.

9. The method of claim 8 wherein the expelling of fluid from the check control chamber to the low pressure drain requires that fluid travel through the orifice, lower bowl and upper bowl of the check speed control device.

10. The method of claim 9, wherein the expelling of fluid from the check control chamber is controlled by a control valve assembly having a valve member that selectively allows fluid communication between the check control chamber and the low pressure drain.

11. The method of claim 10, wherein the check speed control device is welded in place within the check control chamber.

12. The method of claim 11, wherein the check speed control device is positioned above the check needle.

13. The method of claim 7, wherein the upper bowl, lower bowl and at least one orifice of the check speed control device are machined from a single plate.

14. An internal combustion engine comprising:

an engine housing defining a plurality of engine cylinders, and including a plurality of pistons each being movable within a corresponding on of the engine cylinders; and a fuel system including a plurality of fuel injectors associated one with each of the plurality of engine cylinders, wherein at least one of the plurality of fuel injectors further includes:

an injector body defining a high pressure inlet, a nozzle supply passage, a check control chamber, a check control line, a low pressure drain and at least one nozzle outlet;

a check speed control device fixedly positioned within the check control chamber and having an upper bowl, a lower bowl and at least one orifice through the lower bowl;

a control valve assembly having a valve member configured to selectively allow fluid communication from the upper bowl and check control line to the low pressure drain; and a check needle movable within the injector body between a first position at which the check needle blocks the at least one nozzle outlet and a second position at which the check needle at least partially opens the at least one nozzle outlet, the check needle including at least one opening hydraulic surface exposed to a fluid pressure of the nozzle supply passage and at least one closing hydraulic surface exposed to a fluid pressure of the first check control chamber.

15. The internal combustion engine of claim 14, wherein the at least one fuel injector further includes at least one biasing spring configured to bias the check needle toward its first position.

16. The internal combustion engine of claim 15, wherein the at least one fuel injector further comprises an orifice plate defining a z-orifice and an a-orifice, wherein the z-orifice facilitate fluid communication from the nozzle supply passage to the upper bowl and the a-orifice facilitates fluid communication from the upper bowl to the check control line.

17. The internal combustion engine of claim 16, wherein the check speed control device of the at least one fuel injector is welded in place within the check control chamber.

18. The internal combustion engine of claim 17, wherein the check speed control device of the at least one fuel injector is positioned above the check needle.

19. The internal combustion engine of claim 18 further comprising a high pressure fuel pump and a common rail fluidly connected with the high pressure fuel pump and with the high pressure fuel inlet of at least one of the plurality of fuel injectors.

20. The internal combustion engine of claim 14, wherein the upper bowl, lower bowl and at least one orifice of the check speed control device are machined from a single plate.

* * * * *